US009739135B2

(12) United States Patent
Wilkinson et al.

(10) Patent No.: US 9,739,135 B2
(45) Date of Patent: Aug. 22, 2017

(54) EQUIPMENT AND METHODS FOR DOWNHOLE SURVEYING AND DATA ACQUISITION FOR A DRILLING OPERATION

(71) Applicant: GLOBALTECH CORPORATION PTY LTD, Canning Vale, Western Australia (AU)

(72) Inventors: Brett James Wilkinson, Wembly Downs (AU); Michael Alan Klass, Winthrop (AU); Johan Anwar, Kalamunda (AU); Khaled Hejleh, Peppermint Grove (AU); Gordon Stewart, Claremont (AU)

(73) Assignee: Globaltech Corporation Pty Ltd., Canning Vale (AU)

( * ) Notice: Subject to any disclaimer, the term of this patent is extended or adjusted under 35 U.S.C. 154(b) by 207 days.

(21) Appl. No.: 14/372,183

(22) PCT Filed: Jan. 17, 2013

(86) PCT No.: PCT/AU2013/000029
§ 371 (c)(1),
(2) Date: Jul. 14, 2014

(87) PCT Pub. No.: WO2013/106885
PCT Pub. Date: Jul. 25, 2013

(65) Prior Publication Data

US 2014/0375468 A1 Dec. 25, 2014

(30) Foreign Application Priority Data

Jan. 17, 2012 (AU) ..... 2012900171

(51) Int. Cl.
*G01V 3/00* (2006.01)
*E21B 47/01* (2012.01)
(Continued)

(52) U.S. Cl.
CPC ..... *E21B 47/01* (2013.01); *E21B 25/16* (2013.01); *E21B 47/024* (2013.01); *E21B 47/12* (2013.01)

(58) Field of Classification Search
CPC ..... E21B 25/16; E21B 47/01; E21B 47/024; E21B 47/12
(Continued)

(56) References Cited

U.S. PATENT DOCUMENTS 5,412,568 A * 5/1995 Schultz ..... E21B 34/102 166/250.01
6,006,844 A 12/1999 Van Puymbroeck
(Continued)

FOREIGN PATENT DOCUMENTS

AU 2008230012 A1 5/2009
WO 2005078232 A1 8/2005
(Continued)

*Primary Examiner* — Ojiako Nwugo
(74) *Attorney, Agent, or Firm* — Charles H Jew

(57) ABSTRACT

An adaptor (64,66) has attachment means to releasably attach a core orientation instrument (60) or survey probe to a drill string component and/or drill string, preferably by one or more screw threads (70, 72, 76, 78), retaining screws, bolts, clips or pins or welding/soldering. Anti release means, such as a circlip, can be used to prevent release of the adaptor. A survey system for obtaining data from a drilling operation includes a core orientation instrument, a downhole survey probe and a common single remote controller/data logger configured to control or communicate with both the survey probe and the core orientation instrument. Further, a survey system includes multiple components arranged in a portable container for transport and deployment at a drilling site include a survey probe, a core orientation instrument and a single controller configured to control or communicate with the survey probe and core orientation instrument.

39 Claims, 6 Drawing Sheets

(51) Int. Cl.
*E21B 25/16* (2006.01)
*E21B 47/024* (2006.01)
*E21B 47/12* (2012.01)

(58) Field of Classification Search
USPC ..... 340/854.4, 854.5
See application file for complete search history.

(56) References Cited

U.S. PATENT DOCUMENTS

| | | | | |
|---|---|---|---|---|
| 2007/0107939 | A1 | 5/2007 | Goldberg | |
| 2008/0066961 | A1* | 3/2008 | Aivalis | E21B 4/02 175/50 |
| 2010/0236777 | A1 | 9/2010 | Partouche et al. | |
| 2011/0048804 | A1* | 3/2011 | Weixler | E02D 5/385 175/57 |
| 2011/0136568 | A1* | 6/2011 | Buhr | A63F 13/06 463/29 |
| 2012/0061141 | A1* | 3/2012 | Rossing | E21B 23/002 175/45 |
| 2014/0182946 | A1* | 7/2014 | Drenth | E21B 17/00 175/320 |

FOREIGN PATENT DOCUMENTS

| | | | |
|---|---|---|---|
| WO | 2008113127 | A1 | 9/2008 |
| WO | 2010091471 | A1 | 8/2010 |
| WO | 2011056077 | A1 | 5/2011 |

* cited by examiner

EQUIPMENT AND METHODS FOR DOWNHOLE SURVEYING AND DATA ACQUISITION FOR A DRILLING OPERATION

FIELD OF THE INVENTION

The present invention relates to equipment, system and methods for improved downhole surveying and data acquisition at a drill site, such as for obtaining a core orientation sample and handling data relating to the sample.

BACKGROUND TO THE INVENTION

Drillers contracted by mining companies are required to drill numbers of exploratory subsurface drill holes at a chosen mine site to extract underground core samples in order to determine locations of mineralisation and the feasibility to proceed with mineral extraction.

Such operations extract a core during drilling (in 'diamond drill-bit drilling' the bit has a centre hole which allows the core sample to enter through during drilling). Core lengths are variable, but usually between 3 m and 6 m lengths and are extracted progressively for the entire hole.

Each extracted core sample is marked for its orientation position before extraction, with additional survey data of that cores position such as azimuth (angle of North-South deviation), dip angle, depth the core was extracted from and other additional data to verify data correctness. Financial costs associated with such operations are based on distance (meters) drilled, number of holes, sub-surface targets reached and number of targets concluded.

Drill-Rig Activity:

1) Equipment Needed to Achieve the Above Basic Requirements

Inventory of instrumentation and ancillary equipment required to carry out drilling activity such as surveying and core orientation. These pieces of equipment and sub-assemblies have to be possibly transported to remote locations by air cargo, helicopter or by road. In remote areas suitable for mining and drilling operations, such roads are often unsealed and within harsh environmental conditions.

2) Extracting Core Samples During Drilling a) A core-orientation unit is attached to a 'back-end assembly', which is inserted into a drill hole during drilling and is brought to the surface when the core sample is extracted with the core orientation unit.

b) The core orientation unit needs to be removed (unscrewed) from the back-end assembly to begin the process of orienting the extracted core. The core is removed after orientation marking, and then the core orientation unit is re-installed to the back-end assembly before inserting into the drill hole for the next core sample extraction. This process is time consuming and costly considering the high cost of the drill rig on-site and that this process is repeated every 3 or 6 meters of drilling. Drilling depths are usually between 500 meters and 2 km, with deeper drilling expected in the future. To speed up the process, a pair of core orientation units are used on two identical assemblies and alternated when drilling for core samples, however the operator still needs to go through the motion of removing and re-installing the core orientation unit for every sample retrieved.

c) As drilling depths increases, the drill bit size is reduced to cope with the deeper hole drilling, as a consequence, a smaller size diameter core orientation unit is required to follow the reduced hole size. As a norm, drillers need to have three sizes of core orientation units, two of each size, making a total of six core orientation units. These units are usually made of heavy thick walled stainless steel to withstand high pressures during deep hole drilling. This adds substantial weight to the core orientation equipment inventory.

3) Surveying the Drill Hole at Different Depths a) In order to identify the exact underground locations of each extracted core sample, a number of surveys of the drill hole need to be carried out in between the drilling and core extraction process. A survey instrument is used in the drill hole to measure azimuth, hole inclination (or dip), and other data. As a minimum, hole surveys need to be taken every 30 meters of drilling. The hole path/trajectory is then extrapolated mathematically and the extracted *6m* core samples positioning is then calculated from the plotted path.

b) The process of surveying a drill hole at a determined depth involves inserting a 'Survey instrument probe' into a pressure protected brass barrel, attaching the probe pressure barrel to three lengths of 1.2 m aluminium rod extensions (to avoid anomalous magnetic readings when the probe is in close proximity to the drill bit and steel drill pipe extensions), attaching the entire length to a back-end assembly, which is then inserted into the end of the drilled hole and through the hollowed centre of the circular drill bit. With the drill bit and steel piping pulled back past the survey probe and the three rod extensions, a survey reading can then be recorded at the last drilled position of the drill hole. This total assembly including the survey probe, its brass pressure barrel and three aluminium extension rods again adds substantial weight and considerable assembly/disassembly time to the survey process.

c) On retrieving the probe assembly, the probe needs to be removed from the brass pressure barrel in order to retrieve the recorded survey readings from the drill hole. This can be a lengthy process with added care required not to damage the instrument during handling or being dropped in water or mud as would normally be the condition at a drill-rig site.

4) Maintaining a Progressive Drilling Log a) A mandatory requirement for all drilling activity is to record events, activities, instrument data and progress/achievement of underground targets. Traditionally (and still used in many drill rigs globally), the method of recording and logging of drilling activity is carried out painstakingly using manual pen and paper recording methods.

b) The pieces of paper are compiled and manually checked for errors or omissions, corrected after discussions with drill rig operators and on-site geologists, and then sent to the drilling companies' administrative office for manual transfer of data from the 'progressive log of drilling' sheets to computer terminals.

c) To accommodate for multiple site log data entry, there is usually a pool of typists performing the data entry task. Having to re-enter data in this manner can sometimes cause data errors which would then have to be re-checked and corrected as necessary. There is also the need to interpret the handwritten sheets to ensure data is recorded in the required format so it can be used by $3^{rd}$ party software programs which eventually provide billing to the mining companies that contract the drilling companies.

d) If sufficient detailed information can be recorded on the progressive log of drilling sheet process, the drilling company has the added advantage of extracting metrics from the recorded data that can provide a thorough analysis of drill-rig costs (labour and consumables), efficiencies, safety issues etc. This additional data is not always available due to insufficient data recording at the drill rigs because of inaccessibility of the data or time constraints when drilling towards underground targets within a limited time. Summary of current operational methods used for basic activities at drill-rig sites to orient core samples, measure survey data and record all activity at the drill rig site.

To accomplish the above, drill-rig operators use core orientation tools, survey probes and a number of manual pen and paper recording means to log drilling activity and events. Core orientation and Survey tools are available from a number of different international suppliers and attempts have been made to electronically record/log rig activity using 'Tough-books' and other commercially available laptops and hand-held computers. The problems experienced from present operating methods comes from having to manually record data from the variety down-hole instruments source from various 3$^{rd}$ party suppliers, which may or may not have compatible formats, then transferring the data to the overall manual logging sheets or laptop as required for eventual recording and billing to customer.

This current method is prone to human error, possible data incompatibility and excessive time required to compile information which would require further re-compilation at head office to include other neighbouring drill-rig data and activity/events. Time delays and inherent inaccuracies as a result of manual human data recording can cause delays in invoicing and receiving payment, and at worst, not charging for all items due to missing or poor recording methods.

A further inconvenience to the driller is the need to keep an inventory of third party core orientation/survey instruments, different manufacturer spare parts and related consumables such as batteries, long and cumbersome brass pressure barrels to protect survey instruments, sealing/waterproofing 'O' rings and grease to install associated pressure barrel housings before using the survey probes. Apart from having to take stock of a large, and separately cased (if at all) collection of instruments with associated hardware and consumables, the operator has to gain familiarity with each instrument's method of operation and be able to manually record and integrate the various data formats and results into a common 'paper form' which can be later manually keyed in for geologist use or accounting purposes.

The present invention seeks to alleviate or overcome one or more of the aforementioned problems.

With this in mind, it is desirable of one or more forms of the present invention to provide a system or method that utilises a reduced number of components compared with standard systems and which enables common communication between various components.

It is further desirable of one or more embodiments of the present invention to make use of electronic hardware and software to reduce time and cost, with a reduction in overall equipment count and weight and the capability to simplify and streamline instrumentation and operator procedures.

SUMMARY OF THE INVENTION

One or more preferred forms of the present invention advantageously reduces complex operational methods prevalent at most drill rig sites, such as cumbersome handling and operation, incompatible equipment data outputs, and keeping track of multiple activity and events while operating the drill rig according to specified targets in a given time/cost budget.

At least one embodiment of the present invention provides a system incorporating reduced instrumentation component physical size(s) with the aid of component/module miniaturisation. This reduction in physical size of components allows for thicker wall pressure housings that enable component use in deep hole exploration/drilling.

Where preferred, use of composite materials may replace heavier brass and steel housings, making it possible to package pieces of equipment into one or more manageable (and preferably light weight) carrying cases. This adds the further advantage of lower shipment costs and portability, while being able to keep track of all components which fit into moulded receptacles in its carrying case. The instruments and hardware components in a system according to one or more embodiments of the present invention are built to be fully data and function compatible, so much so that a (preferably hand-held) control device is able to be used to initiate, interrogate and control all the survey/core-orientation instruments as well as log all drilling activity/events occurring at the rig.

As a system that offers essential instrumentation required for drill site measurement and logging, there is considerable reduction in size and the number of pieces of equipment in the system compared to presently known and used systems at mining drill-rig sites worldwide.

The following are components of a system according to at least one embodiment of the present invention that contribute to size reduction:

a) Magnetic Survey instrument probe in a short length form less than 500 mm, permanently encased in its own pressure barrel able to withstand pressures up to 6000 psi required for deep hole drilling applications. There is no need to dismantle the pressure barrel to operate or retrieve data from the probe.

b) Compact but extendable lightweight 'rod extensions' to extend the Survey probe past the drill bit to avoid magnetic interference. Having a single short lightweight telescopically extendable piece is critical to keeping overall weight down. At present, the drilling industry typically uses three 1.2 meter solid/heavy aluminium rods joined together to achieve this.

c) Lightweight composite material constructed dual core orientation instruments which can be started and after retrieval set up for core orientation, both without the need to be detached from the running gear/back-end assembly/core barrel.

d) Adaptor attachments to each end of the core orientation instruments render the unit the capability to be used in all standard drill-hole sizes without having to stock different size instruments creating unnecessary duplication and additional space/weight. The attachments are compatible to LTK60, NQ, PQ, HQ and HQ2 drill strings and other drill string sizes commonly used in the industry.

e) A controller or communication device, preferably a hand held controller, (with additional optional pocket size slave controller) that is able to operate all of the instruments in the system as well as optionally record and log all events and activity occurring at the drill-rig site.

f) An easily attachable hand controller/communicator charging device (e.g. mains power or charging from a vehicle battery) which also optionally incorporates a satellite modem communicator for instant transfer of site data and progress logging for analysis, multi-rig monitoring or accounting purposes.

To further reduce human error and increase efficiency at the drill rig site, the included common hand-held controller is able to directly record rig operating conditions by optionally retrofitting rig instrumentation with compatible wireless data interface modules. This enables fast and accurate rig status data acquisition, further automating progressive log of drilling activity.

The system and method of the present invention provides on-site multiple function data integration of simultaneous activity occurring at the rig site without the need for manual recording or calculations. Human error factors are reduced leading to increased work efficiency and safety.

An aspect of the present invention provides a survey system for obtaining data from a drilling operation, the system including at least one core orientation instrument for use in determining orientation of a core sample, at least one downhole survey probe for use in determining characteristics relating to a borehole created during a drilling operation, and a common single controller configured to control or communicate with both the at least one survey probe and the at least one core orientation instrument.

The controller may be arranged to capture survey data and core orientation data, and to transmit said survey and core orientation data in electronic form to a data capture means for later use.

The controller may include means to capture or receive progress log of drilling data.

The controller may be arranged to transmit said progress log of drilling data to the data capture means.

The system may further include at least one telescopic rod extension for direct or indirect connection to the survey probe or the core orientation instrument. The telescopic rod extension may include at least one side wall incorporating or predominantly formed of composite material.

By including one or more adapters for attachment to an end or both ends of the core orientation instrument or survey probe, said adapter(s) may vary the effective diameter of the core orientation instrument or survey probe for attachment to drill string extension components having a respective connecting thread diameter greater than the diameter of a connecting thread of the core orientation instrument or survey probe.

A respective said adapter may be releasably attachable to the core orientation instrument or to the survey probe. Multiple sizes, such as small medium and large (relative to one another) diameter adapters may be provided. A large diameter one of the adapters may be arranged to connect to a smaller diameter said adapter, or said large diameter adapter is arranged to replace said smaller or medium (intermediate size) diameter adapter.

A survey system including multiple components may be arranged to be housed in a portable container for transport and deployment at a drilling site, the multiple components including a survey probe, a core orientation instrument and a single controller configured to control or communicate with the survey probe and core orientation instrument.

The system may further include a telescopic rod extension, thereby alleviating the need for multiple extension rods of fixed length.

Multiple sized adapter collars may be used in adapting the core orientation instrument to threadingly engage with a selected extension barrel.

A further aspect of the present invention provides a method of collecting survey data from a drilling operation, the method including: providing a survey system, the system including at least one survey probe, at least one core orientation instrument and a common single controller, collecting data in the controller from the survey probe and the core orientation instrument, and transmitting said collected data to a data capture means.

The method may include the controller communicating with at least one survey probe, core orientation instrument or drilling operation remote from the controller.

Another aspect of the present invention provides at least one adaptor for attachment to an end of a core orientation instrument or survey probe for use in a survey system, the adaptor including attachment means to releasably attach the adaptor, and thereby the core orientation instrument or survey probe, to at least one drill string component.

The core orientation instrument or survey probe can then be used in a variety of (standard) drill-hole sizes at or greater than the size of the instrument or probe without having to stock different size instruments creating unnecessary duplication and additional space/weight. The adaptor(s) may be compatible to LTK60, NQ, PQ, HQ and HQ2 drill strings and other drill string sizes commonly used in the industry.

Preferably at least one said adaptor is provided for each of the two ends of a core orientation instrument or survey probe. Thus, each end of the instrument or probe can be adapted to connect to a selected same size or larger size drill string component ahead of and behind the instrument or probe.

The at least one adaptor may be releasably attached to the instrument or probe, such as by one or more screw threads, retaining screws, bolts, clips or pins. The adaptor may include a screw thread at one end thereof for releasable engagement with an corresponding screw threaded end of the instrument or probe, and another screw thread at the opposite end of the adaptor for engagement with a corresponding screw thread of another adaptor or a drill string component. Thus single or multiple adaptors may be used to convert the smaller diameter instrument or probe to larger diameter drill string components.

The adaptor may include at least one aperture through a side wall thereof, which allows light from an optical instrument to pass to or from the core orientation instrument or survey probe relative, or to allow lubrication fluid to flow through the adaptor, to or from an exterior.

A weld connection may be provided between the adaptor and the core orientation instrument, the survey probe or the at least one drill string component to prevent subsequent release of the adaptor.

A second controller may be provided. This may be in the form of a handheld device, optionally with reduced functionality compared with the common controller, such as a master controller and slave controller arrangement. The second controller may be configured to communicate with the common controller.

A controller power pack may be provided to supply electrical power to the second controller, and optionally a communication dock enabling data communication between a portable memory device and the second controller when the second controller is docked therewith may be provided. The dock may include a USB port for removable connection of a USB device, such as a memory stick or 'thumb drive'.

The common controller may be arranged and configured to capture survey data or core orientation data, and to transmit said survey or core orientation data in electronic form to a data capture means for later use.

The second controller may also be arranged and configured to capture survey data or core orientation data, and to transmit said survey or core orientation data in electronic form to a data capture means for later use.

The second controller may be arranged and configured to transmit data to the common controller for assimilation or use with other data in the common controller or for transmission to an external data capture device.

The common controller may include means to capture or receive progress log of drilling data. The common controller may also be arranged and configured to transmit said progress log of drilling data to the data capture means.

DESCRIPTION OF PREFERRED EMBODIMENT

Figure 1:
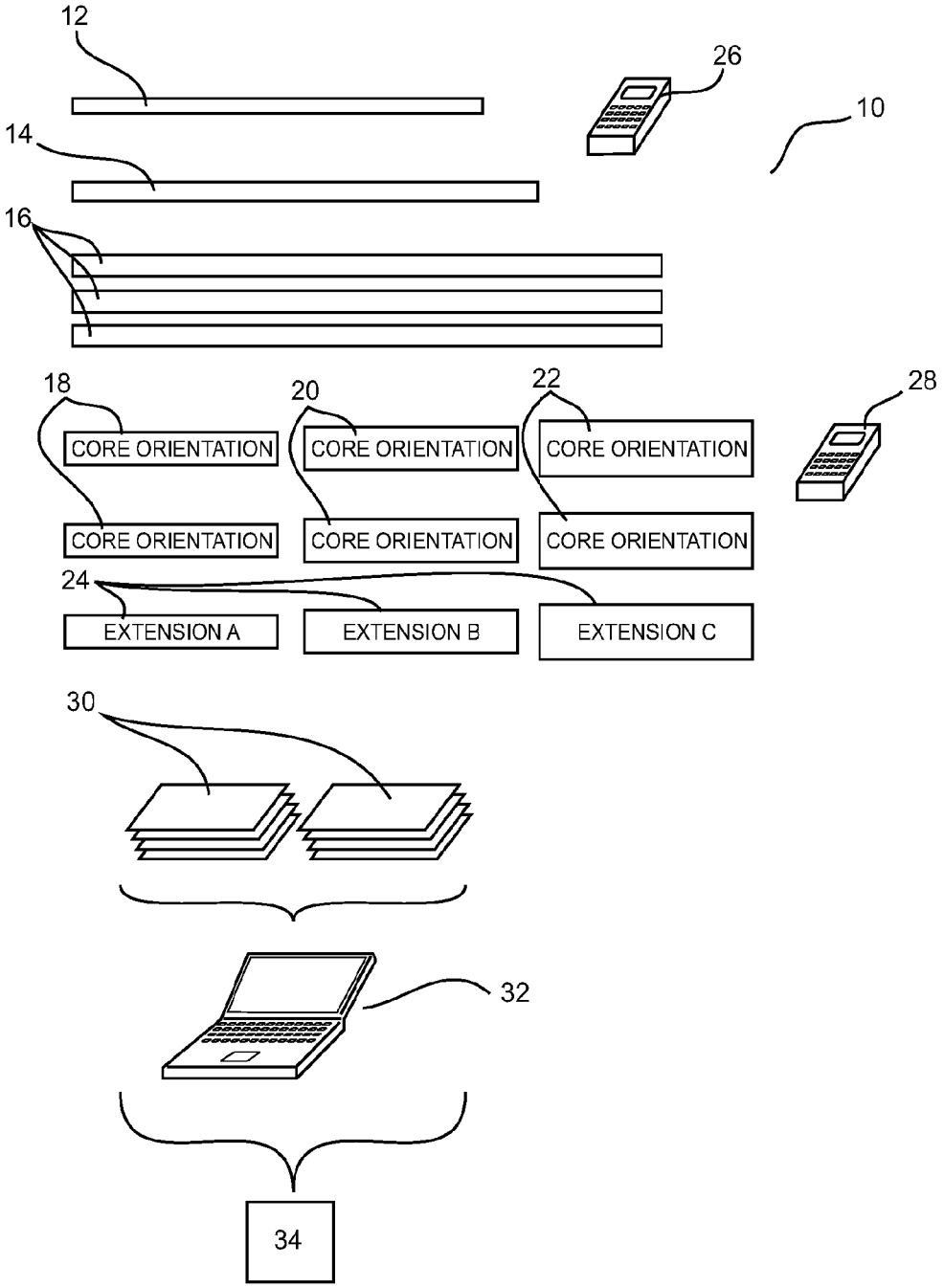
FIG. 1 shows currently used equipment in surveying at a drill site and capturing drilling data.

A known system 10 will first be described with reference to FIG. 1. FIG. 1 shows a comparison of currently required equipment to carry out surveying, core orientation using three sizes for varying drill hole diameters in deep hole drilling, and logging all events and activity at a drill-rig site.

Extracting Core Samples During Drilling

As with the description of known systems and components in the background section above, the common system 10 and method for core extraction and orientation requires a process of dismantling at least two assembly sections to complete the orientation. As every 3 m or 6 m requires core orientation, a significant amount of time is spent during this process. For deep hole drilling where at least three hole sizes are encountered, the equipment count (and weight) for core orientation equipment almost trebles (as seen in FIG. 1). This occurs because a relatively wide borehole can first be drilled. As friction increases with depth, a narrower hole is needed, and then again a third much narrower drill. Thus, three different diameters of core orientation instruments 18, 20, 22 are required to match the three different drill widths. This significantly increases the number of components required in a known system. Matching extension barrels (drill string extensions) are also required to connect the core orientation instrument 18, 20, 22 to the drill string. Because there are three hole sizes, there are three matching extension barrels 24. A core orientation instrument controller 28 is used to control and communicate with the core orientation instrument. This is in addition to a separate survey probe controller, typically because these instruments may come from different manufacturers or are supplied as stand alone sub systems.

Surveying the Drill Hole at Different Depths

The survey instrument/probes 12 used in today's mining industry are of an average length of 1 m or more. They all require operation in a brass pressure barrel 14 which needs to be disassembled from one end (at least) to start the probe's operation and again to stop operation and extract data after removal from a drill-hole. It is inherent for all magnetic survey instruments that an average of 5 m separation of its sensors from the drill bit and steel drill pipes is required before making a valid reading. This is achieved using multiple solid aluminium rod extensions 16. A survey instrument controller 26 is used to control the survey instrument and obtain data from the instrument.

Keeping a Progressive Log of Drilling

As described above and shown in FIG. 1, the industry norm is to use handwritten forms and faxes 30 through to typing pools for data entry 32 and eventual analysis/reporting of data and accounting 34. This long standing method is plagued with human error and lost opportunity through inefficient double and triple handling of data collection and recording drill-rig activity. Client billing cycles are delayed and only sparse analysis (if at all) is available from the collected data.

Figure 2:
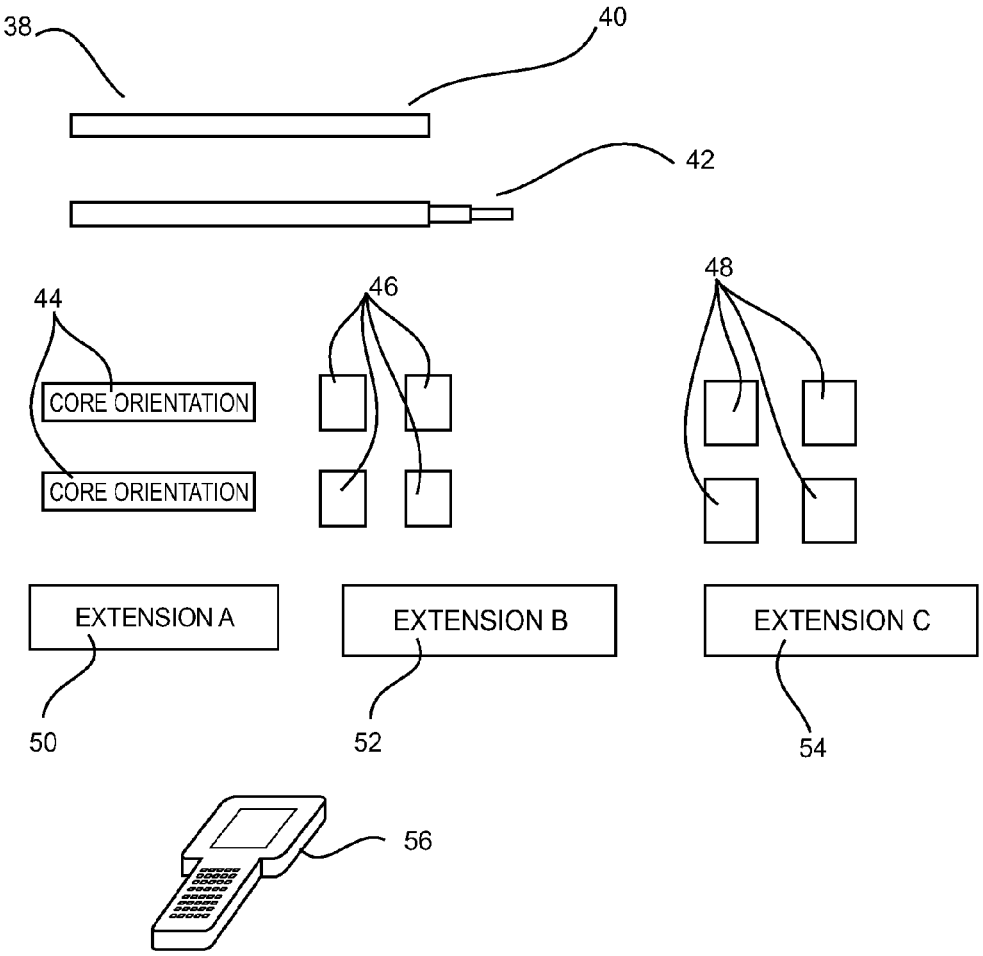
FIG. 2 shows an embodiment of the present invention with reduced number of components compared with currently used systems and including improved data capture and component control through an electronic controller.

An embodiment of the present invention is shown in FIG. 2. Such a system requires fewer components than needed in a known system. Replaceable adapters on the core orientation unit replace the various sizes of core orientation units in known systems. This is a significant saving in equipment costs and operational costs, as well as avoiding the need to transport the additional electronic equipment to and from sites.

Extracting Core Samples During Drilling

For extraction of core samples, the system 38 shown in FIG. 2 uses a single size (smallest diameter size) core orientation unit 18 with multiple size adaptors 46, 48 to match with different stages of deep-hole drilling. This beneficially avoids the need for multiple size core orientation instruments used in the known systems.

Drill string extensions 50, 52, 54 are utilised. Only one section needs to be dismantled to remove the core sample as this core orientation unit has a unique facility to communicate internal data without the need to remove the unit from its back-end attachment.

Surveying the Drill Hole at Different Depths

A system of the present invention can utilise state-of-the-art SMT (Surface Mount Technology) or wire bonding miniaturisation to achieve a survey instrument probe 40 no longer than half a meter (500 mm), be fully encased in its own brass pressure housing, will not need dismantling for the start/stop/extract data process, and achieves magnetic sensor separation using an extendable/telescopic, preferably composite, material extension rod 42. The probe 40 is designed to operate in harsh environments, and with thicker wall pressure housing (due to internal electronic component miniaturisation), is easily adaptable for deep-hole drilling.

Keeping a Progressive Log of Drilling

As seen in FIG. 2, a system of the present invention integrates all functions of an electronic controller 56 with core orientation and survey instrumentation 40, 44, thereby only requiring a single controller rather than the multiple controllers of the known art. The controller can provide seamless and instant electronic data capture and communication for the drilling companies, newly designed hardware and software functions will empower the driller to operate from a central singular (hand-held) controller, with full access and monitoring/validation of all instrument data, consumables, drilling target progressive achievement and full analysis of work progress at the mine site.

The single common controller for communicating with and controlling the core orientation instrument/unit and also the probe(s) avoids the need for multiple controllers. Furthermore, data capture by one controller allows different data sets to be compared or used to derive further data. For example magnetic field data from a probe can be combined with core orientation data to help determine subsurface geological features or potential sites for deposits.

Figure 3:
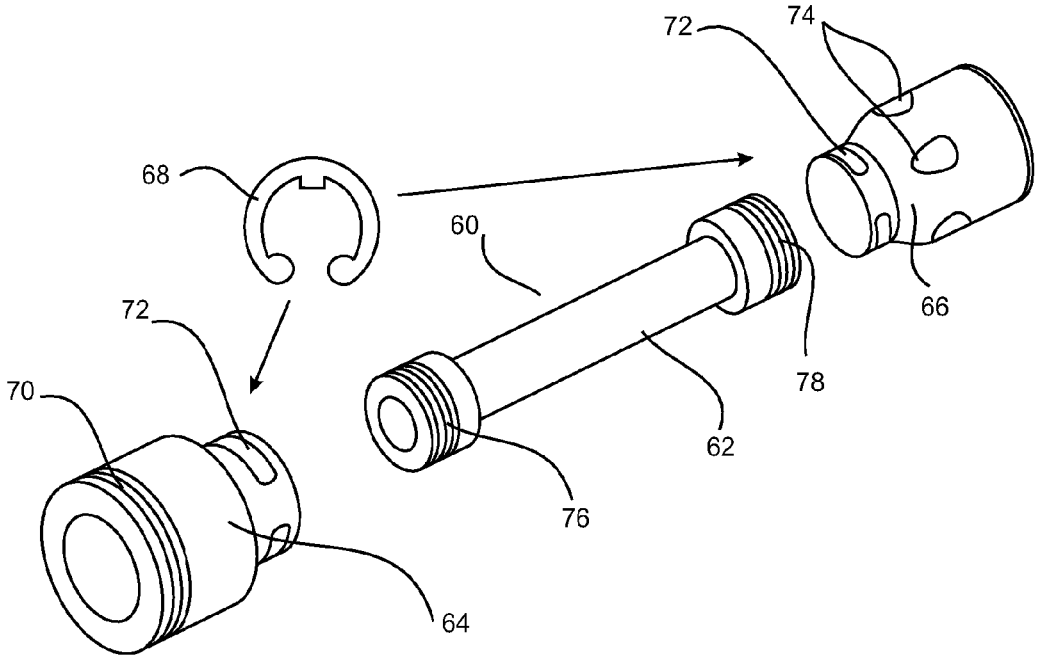
FIG. 3 shows a core orientation instrument with adaptors according to an embodiment of the present invention.

FIG. 3 shows a core orientation instrument 60 with a central body 62 for housing electronics, a first threaded end 76 and a second threaded end 78. The first threaded end is arranged to receive an adaptor 64. This adaptor has an external threaded portion 70 for connection to drill string component, such as a greater unit (not shown). This first adaptor 64 includes an internal thread 80 arranged to threadingly engage with the external first threaded end 76. After screwing the adaptor 64 onto the first end of the core orientation instrument, a circlip 68 is applied to retain the adaptor in place. The circlip engages into grooves 72 through the wall of the adaptor. To prevent the adaptor from unscrewing form the end of the core orientation instrument, the circlip will engage against a shoulder of the end of the core orientation instrument. The circlip must be removed before the adaptor can be unscrewed. At the other end of the core orientation instrument, another external thread 78 is arranged to engage with an adaptor 66. This adaptor has spaced apertures 74 to allow light to transmit data from the core orientation instrument to a light receiver or controller. This adaptor can connect the core orientation instrument to a core barrel. It will be appreciated that the adaptors can be used with other survey tools, such as survey probes.

Figure 4A:
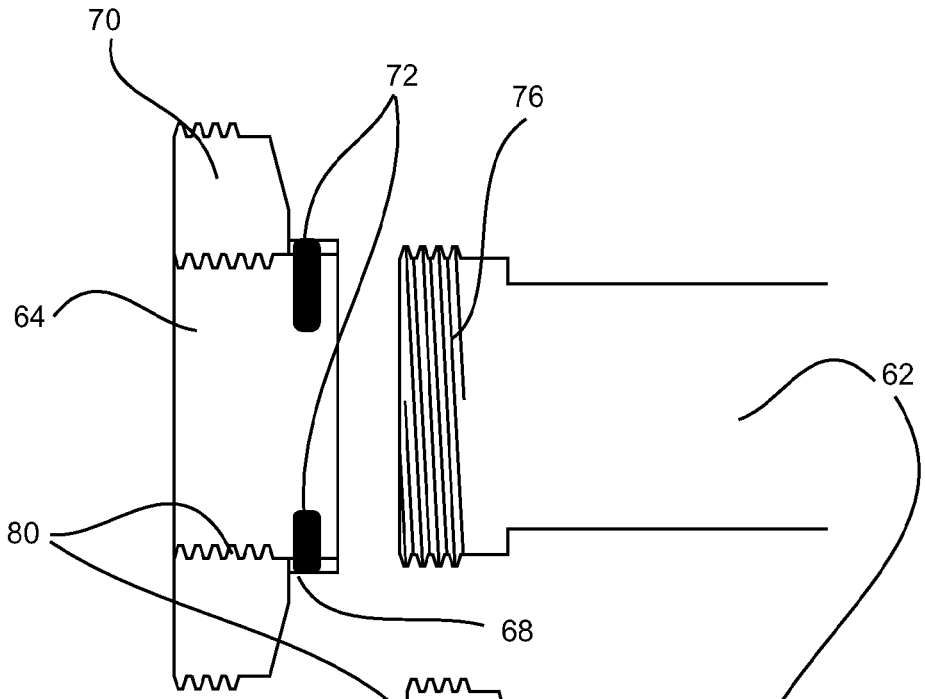
FIGS. 4*a* and 4*b* show in cross section an adaptor for a core orientation instrument according to an embodiment of the present invention.
Figure 4B:
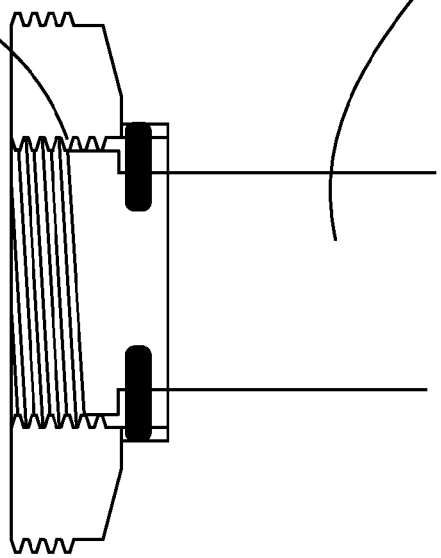

FIGS. 4*a* and 4*b* show an adaptor in cross section. FIG. 4*a* shows the adaptor before it is threaded onto the end of the core orientation instrument, and FIG. 4*b* shows the adaptor attached and the retaining circlip in place.

Figure 5A:
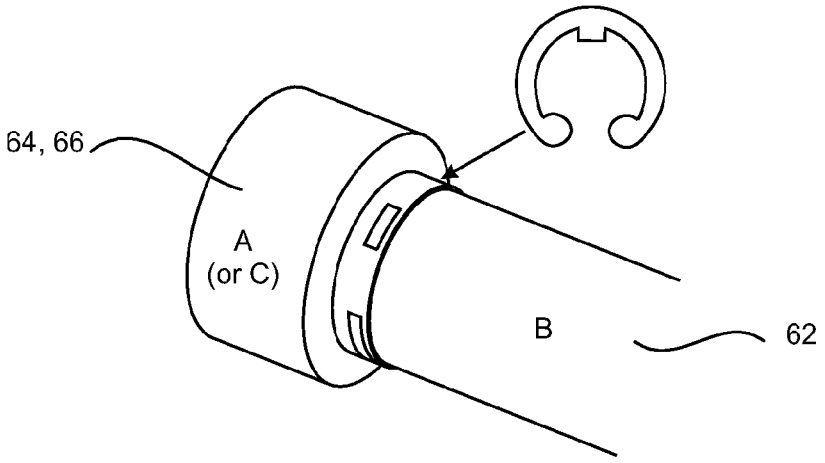
FIGS. 5*a* to 5*c* show alternative versions of an adaptor for a core orientation instrument according to an embodiment of the present invention.
Figure 5B:
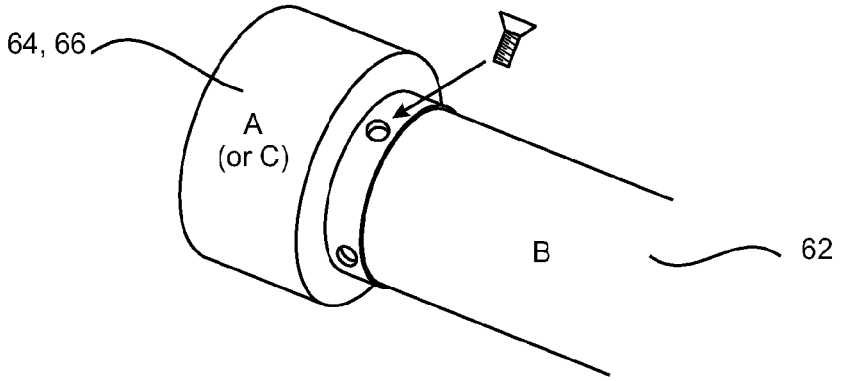
Figure 5C:
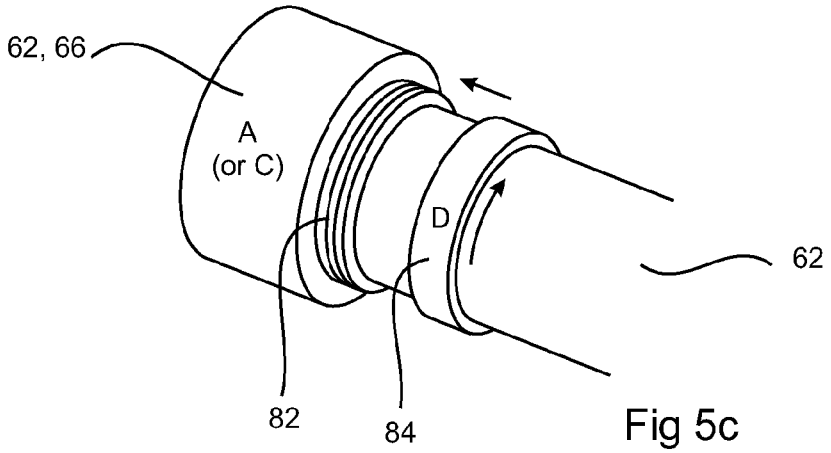

FIGS. 5*a* to 5*c* show alternative arrangements for releasably attaching the adaptor to the core orientation instrument. FIG. 5*a* shows a circlip type retainer, FIG. 5*b* shows a multiple retaining screw (grub screw) alternative. The retaining screws screw into threaded holes through the wall of the adaptor and bite into the wall of the core orientation instrument or engage into holes in the casing of the body. In FIG. 5*c*, a screw threaded locking collar or sleeve 84 threads onto an external thread 82 of the adaptor. Tightening the collar or sleeve clamps the adaptor to the core orientation instrument.

The external threads 70, 78 of the adaptors can be sized to suit the matching required size of the drill string components. Thus, instead of requiring various sizes of core orientation instrument or other survey instrument, only one smaller size of instrument is required and the end connections can be adapted by use of the adaptors to suit a required size of corresponding drill string components. This reduces the number of components required for a survey system, reduces overall capital cost, avoids the need for multiple electronics instruments, and makes the entire system portable in a transportable case.

In use, the second controller may be used to capture data for one surveying task, such as core orientation data, whilst the common controller (considered a master or primary controller) is used for data on a second task, such as handling a log of drilling or survey probe data. All data may be combined by data transmission into one of the controllers, preferably the common controller. Data transmission may be infra red or wireless communication directly from one controller to the next, or from on controller via a docking station to a memory device and thence into the second controller. Alternatively, data from both controllers may be transmitted to a remote device, such as a computer, for further processing.

The docking station may also act as a power charger for an on-board battery in one or both controllers. An AC and/or car battery supply adapter/transformer may be provided as part of the downhole survey system equipment to aid with power and charging of the controllers. Data transmission equipment may also be provided, such as a Wifi or satellite communication enabled device to transmit data to a remote location or device.

Figure 6:
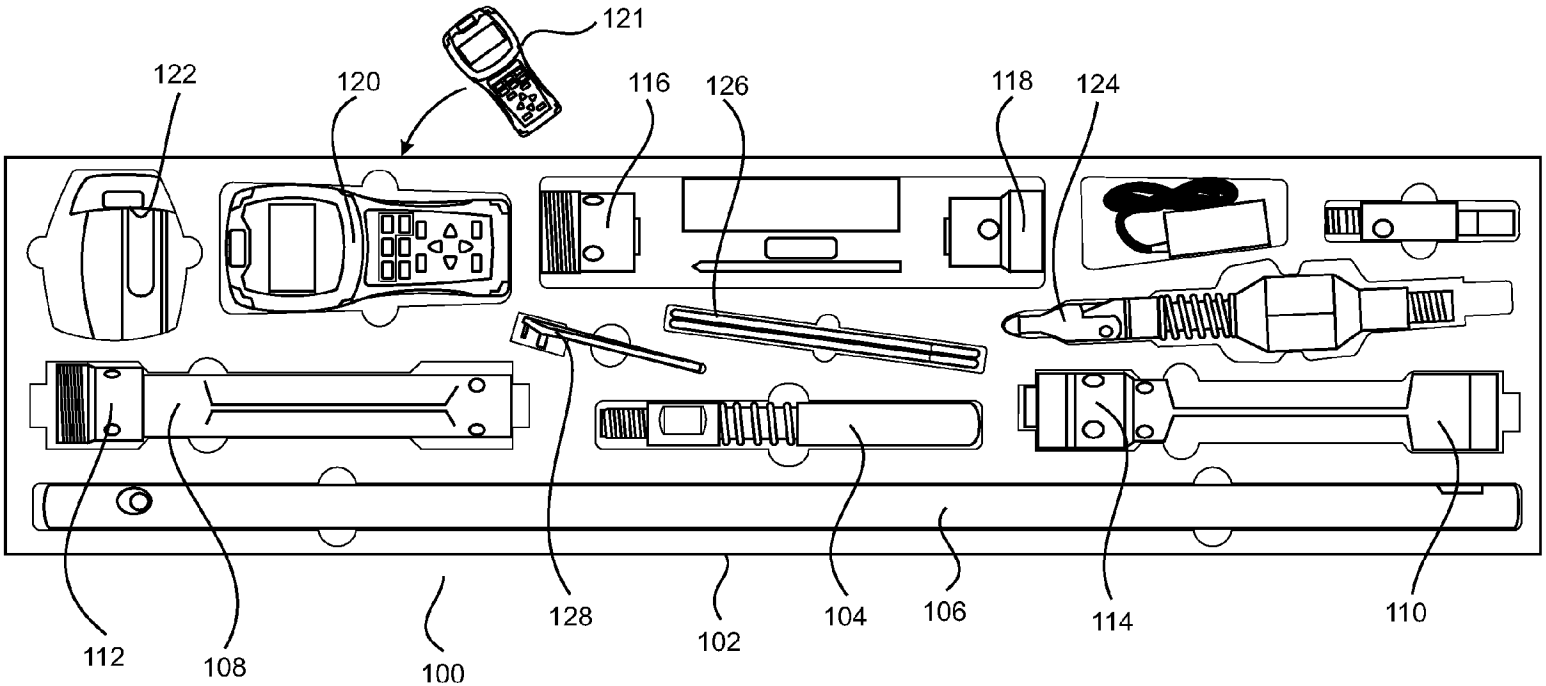
FIG. 6 shows a set of downhole survey system equipment in a storage means for protection and transport.

FIG. 6 shows components of a downhole survey system 100 according to an embodiment of the present invention. The components are housed in a container for safe transport to and from a drill site and for secure storage. This prevents damage to the components and ensures all components in the system are accounted for by providing a particular storage position for each component. The components in the embodiment are shown housed in a protective foam inlay 102 that sits inside the container (not shown). The components include a downhole probe 104, and extension rod 106 (which may be of a preselected length or may be telescopic) to connect the probe to a drill string or other components. One or more downhole instruments, such as core orientation units 108,110, can be included. The system further includes the option to use adaptors 112,114,116,118 etc, to connect one or more of the instruments and/or probes to a drill string. The adaptors are provided according to one or more embodiments of the adaptor of the present invention. One or more of the adaptors includes at least one aperture for entry/exit of light for communicating data to or from an instrument or probe. The system further includes a hand held electronic common controller 120 to receive, transmit and store data relating to a drilling operation obtained by the probe or a core orientation unit. The controller is termed a common controller because it operates with both the probe and at least one of the instruments. Such a controller can communicate with the probe and one or more of the other instruments in the system to receive or send data or instructions to operate the probe or instrument(s) or report on drilling activities, such as a log of drilling. The controller includes a display screen. A second controller 121 is also provide stored underneath the common controller. This second controller can be a slave controller providing reduced functionality compared to the common controller. The second controller can be used to communicate with one of the probe or instrument while the common controller is used to communicate with another of the probe or instrument, or to report on drilling activities, such as a log of drilling. A charging device 122 is also provided. This acts as a power source to charge an on-board respective battery for the common controller and/or second controller. The charging device may provide communication through wifi and/or satellite to a remote device or location. A shock absorber device 124 is also provided to limit shocks through the probe and instrument(s) when in use downhole. Tools, such as spanners 126 are also provided, as well as a core orientation determining device 128.

The invention claimed is:

1. An adaptor for attachment to an end of a core orientation instrument or survey probe for use in a survey system, and attachment means to releasably attach the adaptor, and thereby the core orientation instrument or survey probe, to at least one drill string component, said adaptor releasably attachable to the instrument or probe by one or more screw threads and, when so attached, additionally retainable to the core orientation instrument or survey probe by at least one retainer.

2. The adaptor according to claim 1, the said adaptor provided at each of two ends of the core orientation instrument or of the survey probe.

3. The adaptor according to claim 1, said adaptor releasably retainable to the instrument or probe by one or more retaining screws, bolts, clips or pins.

4. The adaptor according to claim 1, including a screw thread at one end thereof for releasable engagement with a corresponding screw threaded end of the instrument or probe, and another screw thread at the opposite end of the adaptor for engagement with a corresponding screw thread of another adaptor or a drill string component.

5. The adaptor according to claim 1, said adaptor including at least one aperture through a side wall thereof, said at least one aperture allowing electromagnetic radiation from an electronic instrument to pass to or from the core orientation instrument or survey probe relative, or to allow lubrication fluid to flow through the adaptor, to or from an exterior.

6. The adaptor according to claim 5, wherein the electronic instrument is within the core orientation instrument or within the survey probe and the electromagnetic radiation data is transmitted out of the at least one aperture to an external receiver.

7. The adaptor according to claim 1, further including a subsequent weld connection between the adaptor and the core orientation instrument, the survey probe or the at least one drill string component to prevent subsequent release of the adaptor.

8. A downhole survey system for obtaining data from a drilling operation, the system including at least one adaptor as claimed in claim 1, the core orientation instrument for use in determining orientation of a core sample, the survey probe for use in determining characteristics relating to a borehole created during a drilling operation, and a common controller configured to control or communicate with both the survey probe and the core orientation instrument.

9. The downhole survey system according to claim 8, wherein the common controller includes means to capture or receive progress log of drilling data.

10. The downhole survey system according to claim 9, wherein the common controller is arranged to transmit said progress log of drilling data to the data capture means.

11. The downhole survey system according to claim 8, including one or more adaptors for attachment to an end or both respective ends of the core orientation instrument or survey probe, said adapter(s) arranged to vary the effective diameter of the core orientation instrument or survey probe for attachment to drill string extension components having a respective connecting thread diameter greater than the diameter of a connecting thread of the core orientation instrument or survey probe.

12. The downhole survey system according to claim 11, wherein a said respective adaptor is releasably attachable to the core orientation instrument or to the survey probe.

13. The downhole survey system according to claim 11, wherein a larger diameter adapter is arranged to connect to a smaller diameter said adaptor, or said larger diameter adapter is arranged to replace said smaller diameter adapter.

14. The adaptor according to claim 8, wherein the receiver is a common controller for use in controlling or communicating with the core orientation instrument and the survey probe.

15. The downhole survey system according to claim 1, further including at least one telescopic rod extension for direct or indirect connection to the survey probe or the core orientation instrument.

16. The downhole survey system according to claim 15, wherein the telescopic rod extension includes at least one side wall incorporating or predominantly formed of composite material.

17. A downhole survey system for obtaining data from within a borehole of a drilling operation, the system including at least one core orientation instrument for use in determining orientation of a core sample, the at least one core orientation instrument having an internal communicator, the system further including at least one downhole survey probe for use in determining downhole characteristics relating to a borehole created during a drilling operation, the at least one downhole survey probe having an internal communicator, and the system including a common controller retained at the surface and configured to control or communicate with the respective internal communicator of the at least one survey probe and the at least one core orientation instrument when the respective at least one core orientation instrument or the at least one survey probe is returned to the surface from the borehole.

18. The downhole survey system according to claim 17, further including a second controller retained at the surface to communicate with the respective internal communicator of each of the at least one core orientation instrument and with each of the at least one downhole survey probe.

19. The downhole survey system according to claim 18, wherein the second controller is configured to communicate with the common controller.

20. The downhole survey system according to claim 18, further including a controller power pack to supply electrical power to second controller, and a communication dock enabling data communication between a portable memory device and the second controller when the second controller is docked therewith.

21. The downhole survey system according to claim 18, wherein the second controller is arranged and configured to capture survey data or core orientation data, and to transmit said survey or core orientation data in electronic form to a data capture means for later use.

22. The downhole survey system according to claim 21, wherein the second controller is arranged and configured to transmit data to the common controller for assimilation or use with other data in the common controller or for transmission to an external data capture device.

23. The downhole survey system according to claim 8, wherein the common controller is arranged and configured to capture survey data or core orientation data, and to transmit said survey or core orientation data in electronic form to a data capture means for later use.

24. A downhole survey system including multiple components arranged to be housed in a portable container for transport and deployment at a drilling site, the multiple components including a survey probe for deployment downhole, a core orientation instrument for deployment downhole, and a common controller retained aboveground at the drilling site and configured to control or communicate with one or both of the survey probe and core orientation instrument when recovered aboveground from downhole.

25. The downhole survey system according to claim 24, further including a telescopic rod extension.

26. The downhole survey system according to claim 24, further including multiple sized adaptor collars for use in adapting the core orientation instrument to threadingly engage with a selected extension barrel.

27. The downhole survey system according to claim 24, including one or more adaptors for attachment to an end or both respective ends of the core orientation instrument or survey probe, said adapter(s) arranged to vary the effective diameter of the core orientation instrument or survey probe for attachment to drill string extension components having a respective connecting thread diameter greater than the diameter of a connecting thread of the core orientation instrument or survey probe.

28. The downhole survey system according to claim 27, wherein a said respective adaptor is releasably attachable to the core orientation instrument or to the survey probe.

29. The downhole survey system according to claim 28, wherein a larger diameter adapter is arranged to connect to a smaller diameter said adaptor, or said larger diameter adapter is arranged to replace said smaller diameter adapter.

30. A method of collecting downhole survey data from a drilling operation, the method including: providing a downhole survey system, the system including at least one survey probe, at least one core orientation instrument and a common controller, collecting data in the common controller retained aboveground from one or both of the survey probe and the core orientation instrument having gathered data downhole and subsequently retrieved to aboveground, and the common controller transmitting said collected data to a common data capture means which records the collected data from one or both of the survey probe and the core orientation instrument.

31. The method according to claim 30, wherein the common controller communicates remotely with at least one survey probe, core orientation instrument or drilling operation remote from the controller.

32. An adaptor for attachment to an end of a core orientation instrument or survey probe for use in a survey system, and attachment means to releasably attach the adaptor, and thereby the core orientation instrument or survey probe, to at least one drill string component, and wherein the adaptor includes at least one aperture through a side wall thereof, the at least one aperture permitting electromagnetic radiation from an electronic instrument transmitting data via the electromagnetic radiation to pass to or from the core orientation instrument or survey probe.

33. The adaptor according to claim 32, the said adaptor provided at each of two ends of the core orientation instrument or of the survey probe.

34. The adaptor according to claim 32, said adaptor releasably attachable to the instrument or probe by one or more screw threads, retaining screws, bolts, clips or pins.

35. The adaptor according to claim 34, said adaptor further releasably retainable to the instrument or probe by one or more retaining screws, bolts, clips or pins.

36. The adaptor according to claim 32, including a said screw thread at one end thereof for releasable engagement with a corresponding screw threaded end of the instrument or probe, and another screw thread at the opposite end of the adaptor for engagement with a corresponding screw thread of another adaptor or a drill string component.

37. The adaptor according to claim 32, further including a subsequent weld connection between the adaptor and the core orientation instrument, the survey probe or the at least one drill string component to prevent subsequent release of the adaptor.

38. The adaptor according to claim 32, wherein the electronic instrument is within the core orientation instrument or within the survey probe and the electromagnetic radiation data is transmitted out of the at least one aperture to an external receiver.

39. The adaptor according to claim 38, wherein the receiver includes a common controller for use in controlling or communicating with the core orientation instrument and the survey probe.

* * * * *